US007287534B2

(12) United States Patent
Diehl et al.

(10) Patent No.: US 7,287,534 B2
(45) Date of Patent: Oct. 30, 2007

(54) CLEANING OF APPARATUS IN WHICH METH(ACRYLIC) ACID-CONTAINING ORGANIC SOLVENTS HAVE BEEN TREATED AND/OR GENERATED

(75) Inventors: Volker Diehl, Ellerstadt (DE); Ulrich Jäger, Römerberg (DE); Jürgen Schröder, Ludwigshafen (DE); Joachim Thiel, Neustadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 646 days.

(21) Appl. No.: 10/447,227

(22) Filed: May 29, 2003

(65) Prior Publication Data

US 2004/0026228 A1 Feb. 12, 2004

(30) Foreign Application Priority Data

Aug. 9, 2002 (DE) ..... 102 37 061

(51) Int. Cl.
*B08B 9/00* (2006.01)

(52) U.S. Cl. ..... 134/22.1; 134/8; 134/22.11; 134/22.12; 134/22.15; 134/22.18; 134/30; 134/34; 134/26; 134/37; 134/42

(58) Field of Classification Search ..... 134/8, 134/22.1, 22.11, 22.12, 22.15, 22.18, 30, 134/34, 26, 37, 42
See application file for complete search history.

(56) References Cited

U.S. PATENT DOCUMENTS

| | | | | |
|---|---|---|---|---|
| 3,454,542 | A * | 7/1969 | Eberhardt et al. | 528/500 |
| 3,679,764 | A * | 7/1972 | Hinton et al. | 585/623 |
| 3,932,500 | A | 1/1976 | Duembgen et al. | |
| 4,236,973 | A * | 12/1980 | Robbins | 203/10 |
| 4,308,076 | A * | 12/1981 | Knowlton | 134/10 |
| 4,347,098 | A * | 8/1982 | Hubby | 159/16.3 |
| 4,411,736 | A * | 10/1983 | Hubby | 159/47.1 |
| 4,488,934 | A * | 12/1984 | Silvis | 202/158 |
| 4,496,770 | A | 1/1985 | Duembgen et al. | |
| 5,087,744 | A | 2/1992 | Krabetz et al. | |
| 5,191,062 | A * | 3/1993 | Bernier et al. | 528/483 |
| 5,198,578 | A | 3/1993 | Etzkorn et al. | |
| 5,356,482 | A * | 10/1994 | Mehta et al. | 134/22.1 |
| 5,426,221 | A | 6/1995 | Willersinn | |
| 5,583,084 | A | 12/1996 | Martin et al. | |
| 5,728,272 | A | 3/1998 | Hammon et al. | |
| 5,739,391 | A | 4/1998 | Ruppel et al. | |
| 5,780,679 | A | 7/1998 | Egly et al. | |
| 5,821,390 | A | 10/1998 | Ruppel et al. | |
| 5,831,124 | A | 11/1998 | Machhammer et al. | |
| 5,855,743 | A | 1/1999 | Herbst et al. | |
| 6,332,958 | B1 * | 12/2001 | Matsuda et al. | 203/49 |
| 6,350,906 | B2 | 2/2002 | Machhammer et al. | |
| 6,413,379 | B1 | 7/2002 | Machhammer et al. | |
| 6,568,406 | B2 * | 5/2003 | Aichinger et al. | 134/22.13 |
| 2001/0007043 | A1 | 7/2001 | Machhammer et al. | |
| 2001/0016668 | A1 * | 8/2001 | Mitsumoto et al. | 562/600 |
| 2001/0025122 | A1 * | 9/2001 | Hirao et al. | 562/600 |
| 2003/0028052 | A1 | 2/2003 | Hirao et al. | |
| 2004/0102351 | A1 * | 5/2004 | Jansen et al. | 510/407 |
| 2004/0158096 | A1 * | 8/2004 | Nestler et al. | 560/217 |
| 2004/0238006 | A1 * | 12/2004 | Sears et al. | 134/19 |
| 2004/0260122 | A1 * | 12/2004 | Yada et al. | 562/600 |
| 2005/0115590 | A1 * | 6/2005 | Schroeder et al. | 134/34 |

FOREIGN PATENT DOCUMENTS

| | | | |
|---|---|---|---|
| DE | 21 36 396 | | 2/1973 |
| DE | 43 08 087 | | 9/1994 |
| DE | 44 31 949 | | 3/1995 |
| DE | 44 31 957 | | 3/1995 |
| DE | 44 05 059 | | 8/1995 |
| DE | 44 36 243 | | 4/1996 |
| DE | 195 36 179 | | 4/1997 |
| DE | 196 06 877 | | 8/1997 |
| DE | 198 10 962 | | 9/1999 |
| DE | 102 11 273 | A1 | 3/2003 |
| DE | 102 13 027 | A1 | 3/2003 |
| DE | 10211273 | * | 3/2003 |
| EP | 0 092 097 | | 10/1983 |
| EP | 0 117 146 | | 8/1984 |
| EP | 0 253 409 | | 1/1988 |
| EP | 0 297 445 | | 1/1989 |
| EP | 0 722 926 | | 7/1996 |
| EP | 0 982 287 | | 3/2000 |
| EP | 0 982 288 | | 3/2000 |
| EP | 0 982 289 | | 3/2000 |
| EP | 1 033 359 | A2 | 9/2000 |

(Continued)

OTHER PUBLICATIONS

Kirk-Othmer, Encyclopedia of Chemical Technology, 3rd Ed., Wiley, New York, vol. 12, pp. 133-134 (1980).

(Continued)

*Primary Examiner*—Sharidan Carrillo
(74) *Attorney, Agent, or Firm*—Oblon, Spivak, McClelland, Maier & Neustadt, P.C.

(57) ABSTRACT

A process for cleaning apparatus in which (meth)acrylic acid-containing organic solvents have been treated and/or generated and contain fouling and/or polymer and residues of organic solvent, in which the apparatus contents are subjected to a steam distillation in the apparatus.

20 Claims, No Drawings

FOREIGN PATENT DOCUMENTS

| | | | |
|---|---|---|---|
| EP | 1 125 912 | | 8/2001 |
| JP | 63198648 | * | 8/1988 |
| WO | WO99-20595 | * | 4/1999 |
| WO | WO9920595 | * | 4/1999 |
| WO | WO 01/51159 | | 7/2001 |
| WO | DE10211273 | * | 3/2003 |

OTHER PUBLICATIONS

Ullmann's Encyclopedia of Industrial Chemistry, 5th completely Rev. Ed., vol. B3, Unit Operations II, p. 2-101(1 page) (1988).

* cited by examiner

CLEANING OF APPARATUS IN WHICH METH(ACRYLIC) ACID-CONTAINING ORGANIC SOLVENTS HAVE BEEN TREATED AND/OR GENERATED

The present invention relates to a process for cleaning apparatus in which (meth)acrylic acid-containing organic solvents have been treated and/or generated and contain fouling and/or polymer formed in an undesired manner and residues of the organic solvent.

(Meth)acrylic acid is used in this document as an abbreviated notation and represents acrylic acid or methacrylic acid.

(Meth)acrylic acid, either itself or in the form of its esters, is of importance in particular for preparing polymers for highly varying fields of application, for example use as adhesives.

(Meth)acrylic acid itself is obtainable principally by heterogeneously catalyzed gas phase oxidation of alkanes, alkanols, alkenes or alkenals which contain 3 or 4 carbon atoms. (Meth)acrylic acid is particularly advantageously obtainable, for example, by catalytic gas phase oxidation of propane, propene, acrolein, tert-butanol, isobutene, isobutane, isobutyraldehyde or methacrolein.

Other conceivable starting compounds are those from which the actual $C_3$-/$C_4$-starting compound is first formed as the intermediate during the gas phase oxidation. The methyl ether of tert-butanol is an example thereof.

These starting gases, generally diluted with inert gases such as nitrogen, $CO_2$, saturated hydrocarbons and/or steam, are passed in a mixture with oxygen at elevated temperatures (customarily from 200 to 400° C.) and also optionally increased pressure over transition metal (for example, Mo-, V-, W- and/or Fe-containing) mixed oxide catalysts and oxidatively converted to (meth)acrylic acid (cf., for example, DE-A 4405059, EP-A 253409, EP-A 92097, DE-A 4431957 and DE-A 4431949).

Owing to numerous parallel and subsequent reactions in the course of the catalytic gas phase oxidation and also owing to the inert dilution gases to be used, the catalytic gas phase oxidation does not, however, provide pure (meth) acrylic acid, but instead a reaction gas mixture which substantially comprises (meth)acrylic acid, the inert dilution gases and by-products, from which the (meth)acrylic acid has to be removed.

Customarily, (meth)acrylic acid is removed via absorptive, extractive, desorptive and/or rectificative separating processes using organic solvents in highly varying apparatus.

In general, the (meth)acrylic acid formed is first absorbed in a suitable absorbent (for example, water or a preferably high-boiling organic solvent) from the gas phase oxidation reaction gas mixture, optionally after indirect and/or direct cooling using an organic or inorganic solvent. Desorptive, extractive and/or rectificative separation of the absorbate then typically provides (meth)acrylic acid of high purity.

For example, DE-A 4436243 relates to a process for removing (meth)acrylic acid from the catalytic gas phase oxidation reaction gas mixture by countercurrent absorption using a high-boiling inert organic liquid, wherein the reaction gas mixture is passed in countercurrent to the descending high-boiling inert hydrophobic organic liquid in an absorption column, a rectification process is superimposed upon the absorption process occurring naturally in the absorption column by removing a quantity of energy from the absorption column which exceeds its natural energy loss resulting from contact with the ambient temperature, and the (meth)acrylic acid(is rectificatively removed overhead from the liquid effluent leaving the absorption column (absorbate) which contains (meth)acrylic acid and the absorbent as its main components.

High-boiling inert hydrophobic organic liquids (absorbents) preferred by DE-A 4436243 include all organic liquids whose boiling point at atmospheric pressure (1 atm) is above the boiling temperature of (meth)acrylic acid and have an at least 70% by weight content of molecules which contain no externally acting polar groups and are accordingly, for example, not in a position to form hydrogen bonds.

EP-A 117146 relates to a process for removing acrylic acid from the catalytic gas phase oxidation reaction gas mixture by absorbing acrylic acid in an absorption column operated using water. Extraction with ethyl acetate removes the acrylic acid from the liquid effluent and acrylic acid is recovered rectificatively from the extract as the bottom fraction.

DE-A 19606877 discloses the initial cooling of the acrylic acid-containing reaction gas mixture resulting from the gas phase oxidation of propene and/or propane by partial evaporation of a high-boiling organic solvent in a direct condenser C9. This involves the condensation of the high-boiling secondary components of the reaction gas mixture in the unevaporated solvent. A substream from the direct condenser (quench) C9 is subjected to solvent distillation to distill over the solvent and leave the high-boiling secondary components behind. The latter can be further concentrated and disposed of, for example, incinerated.

A column C10, which is preferably a valve tray column or a combination of valve trays (above) and a few dual flow trays (in the lowermost region of the column), is charged with the same solvent from above, while the solvent evaporated in C9 and the gaseous reaction product are passed from below into column C10 and then cooled to the absorption temperature. Cooling is advantageously effected via the reflux withdrawn from the absorption column, which passes through external cooling circuits. After the reaction gas stream has been cooled to the absorption temperature, the actual absorption is effected. The acrylic acid contained in the reaction gas and also a portion of low-boiling secondary components are absorbed. The unabsorbed, remaining reaction gas is cooled further, in order to condense secondary components which are difficult to comparatively condense and also steam contained therein and to remove them as dilute acid. The gas stream still remaining is advantageously partially disposed of and partially (recycle gas) recirculated as diluent gas into the gas phase oxidation or used for stripping. At the bottom of column C10, the solvent laden with acrylic acid and secondary components is withdrawn and passed to a desorption column C20.

In the desorption column C20, the majority of low-boilers is stripped from the laden solvent using a portion of the recycle gas. Since relatively large acrylic acid quantities are also stripped, this stream is advantageously recirculated into the direct condenser C9 or passed into the lower portion of column C10 below the fresh solvent feed.

To increase the desorption performance of column C20, the low-boilers present in the recycle gas used as stripping gas are removed before it enters C20. In process technological terms, this is advantageously effected by purifying the stripping gas using worked-up solvent from the column C30 described in more detail below in a countercurrent scrubbing column C19.

In the next process step, a virtually low-boiler-free, acrylic acid-laden solvent stream is withdrawn from the bottom of desorption column C20 and passed to the distillation column C30, which is preferably a sieve tray column. In the bottom of column C30, the high-boiling solvent and secondary components, for example maleic anhydride, condense. In order to avoid the acrylic acid withdrawn at the top of column C30 still containing significant quantities of low-boiling components, this low-boiler fraction is advantageously reduced by lengthening the rectifying section of column C30 to such an extent that the acrylic acid can be withdrawn from the column as a sidestream. Since the low-boiler-rich stream withdrawn at the top of column C30 still contains acrylic acid, it is advantageously recycled into absorption column C10. A substantial proportion of the substantially low-boiler- and acrylic acid-free solvent withdrawn from the bottom of rectification column C30 is passed to the countercurrent scrubbing column C19, in order, as already mentioned above, to scrub the low-boilers out of the stripping gas stream which leads into desorption column C20. Apart from a small substream, the virtually acrylic acid-free solvent is then fed back to absorption column C10. Together with the small substream of the virtually acrylic acid-free solvent, the dilute acid, which still contains dissolved acrylic acid, is treated extractively. This dilute acid extraction recovers a portion of the acrylic acid from the dilute acid, while the dilute acid at the same time extracts all polar components from the solvent stream. The remaining dilute acid may be pre-evaporated and then incinerated.

This processing method of DE-A 19606877 shall be referred to hereinbelow as acrylic acid standard removal (for the purposes of this standard removal, all columns used may also be dual flow tray columns). Useful high-boiling organic solvents for the acrylic acid standard removal include in particular mixtures of diphenyl ether (from 70 to 75% by weight) and diphenyl (from 25 to 30% by weight). A particularly advantageous high-boiling hydrophobic organic absorption liquid in this process is a mixture consisting of a mixture of from 70 to 75% by weight of diphenyl ether and from 25 to 30% by weight of diphenyl, and also, based on the overall mixture, from 0.1 to 25% by weight of o-dimethyl phthalate. In principle, all other high-boiling organic liquids recommended by EP-A 722926 may also be used.

Common to the acrylic acid standard removal described and also the (meth)acrylic acid removals from the gas phase oxidation product gas mixtures cited in this document or described in documents DE-A 19810962, EP-A 1125912, EP-A 722926, DE-A 4308087, EP-A 297445, DE-A 2136396, EP-A 982288, EP-A 982289 and EP-A 982287 is that (meth)acrylic acid-containing organic solvents are treated and/or generated in apparatus (for example, by absorbing (meth)acrylic acid from the gas phase into an organic solvent).

These apparatus are in particular rectification columns, absorption columns, desorption columns and extraction columns. Such columns are customarily columns in a quite general sense with highly varying internals. Examples of such internals include trays (such as dual flow trays, sieve trays, valve trays, Thormann trays, tunnel cap trays and/or bubble cap trays), packings, Raschig rings and/or Pall rings.

However, the apparatus may be quite different, for example evaporators, as are indispensable for thermal separating processes and are described, for example, in EP-A 854120, or condensers or mixing devices.

A disadvantage is then that (meth)acrylic acid, even in the presence of polymerization inhibitors, for example, N-oxyl radicals, phenothiazine, the monomethyl ether of hydroquinone, hydroquinone, etc., has a marked tendency to polymerize, in particular when in the liquid phase. This becomes noticeably disadvantageous in particular in thermal separating processes which subject the (meth)acrylic acid monomers to comparatively high thermal stresses.

As a result, apparatus in which (meth)acrylic acid-containing organic solvent is treated or generated is subject in the course of time to the formation of undesirable deposits which consist of polymer and/or other fouling solids and in extreme cases block the apparatus and are able to reduce the permeability or the ability thereof to transfer heat. It is therefore necessary from time to time to empty and clean the above-described apparatus.

DE-A 19746688, DE-A 19536179, EP-A 1033359, DE-A 10213027 and DE-A 10211273 disclose such cleaning processes.

They consist in treating the emptied apparatus containing essentially only undesirably formed polymer and/or fouling and residues of the organic solvent and (meth)acrylic acid initially with (meth)acrylic acid or water and then with the aqueous solution of a basic salt. In the latter step at the latest, the polymer/fouling formed is completely dissolved and the resulting aqueous solution can be disposed of.

The solution to the abovementioned disposal question is not trivial. Since the aqueous solution contains salts, incineration thereof would result in smoke (salt-containing off-gas).

Degradation of the organic burden of the aqueous solution to be disposed of by aerobic (oxygen-breathing) microorganisms (for example in a water treatment plant) would accordingly be desirable. However, this is generally associated with difficulties, since the organic burden of the relevant aqueous solution is frequently too high for bacterial degradation.

Comprehensive investigations determined that this partly results from the polymer and/or fouling layer which has to be cleaned off the apparatus surfaces also containing absorbed and/or adsorbed solvent, which is why the relevant aqueous solution is normally not only burdened with dissolved polymer/fouling, but also with the organic solvent. This is all the more true when the apparatus has dead spaces where organic solvent remains during emptying and can be flushed into the aqueous flushing solution during subsequent flushing. Finally, the abovementioned facts also result in solvent losses.

DE-A 10213027 therefore recommends initially extractively removing the residues of the organic solvent contained in the fouling and/or polymer using (meth)acrylic acid and recycling the mixture of (meth)acrylic acid and residues of the organic solvent into the process of removing (meth)acrylic acid from the gas phase oxidation reaction mixture.

However, a disadvantage of this procedure is that (meth) acrylic acid which has already been removed is mixed again with organic solvent.

Although DE-A 10213027 recommends conducting a gas through the column (e.g. air or nitrogen or steam) in countercurrent to the flushing liquid which is then conducted downward when the apparatus to be cleaned is a column, steam is recommended only when the flushing liquid itself is aqueous. However, the latter is only the case after extraction with (meth)acrylic acid, i.e. after removal of the residues of the organic solvent.

Similarly, DE-A 10211273 discloses the flushing of the apparatus (a tray column) initially with water to very substantially free it of solvent and the recovery of organic solvent residues contained in the resulting flushing water by subsequent steam distillation.

Only for the subsequent flushing using a basic liquid is it recommended to conduct a gas through the tray column in countercurrent to the flushing liquid. In the implementation example, air is used as such a gas.

A disadvantage of the abovementioned procedure is that the steam distillation and the flushing with water have to be carried out spatially separated.

It is an object of the present invention to provide a process for cleaning apparatus in which (meth)acrylic acid-containing organic solvents have been treated and/or generated and contain fouling and/or polymer formed in an undesired manner and residues of organic solvent (for example in dead spaces), which does not have the disadvantages of the prior art processes.

We have found that this object is achieved by a process for cleaning apparatus in which (meth)acrylic acid-containing organic solvents have been treated and/or generated and contain fouling and/or polymer formed in an undesired manner and residues of organic solvent, which comprises subjecting the apparatus contents to a steam distillation in the apparatus, condensing the vapor phase removed from the apparatus and separating the resulting condensate into an aqueous and an organic phase, the organic phase comprising residues of organic solvent.

A steam distillation of the contents of the apparatus refers to any process in which, on the one hand, steam is generated in the apparatus to be cleaned and/or steam is fed to the apparatus to be cleaned and, on the other hand, vapor phase is withdrawn from the apparatus to be cleaned.

The procedure may be, for example, as follows. The apparatus, which is generally emptied apart from the fouling and/or polymer formed and residues of the organic solvent and also small amounts of (meth)acrylic acid is filled with water or an aqueous basic solution (i.e. with an aqueous flushing liquid), e.g. an aqueous alkali metal hydroxide solution, preferably sodium hydroxide and/or potassium hydroxide, (columns in particular are generally only part-filled; the amount is normally such that the evaporator and pumps can be operated) which may be preheated. The aqueous phase is then boiled and therefore steam is generated, for example by means of suitable heat exchangers, and/or heated steam is conducted into the apparatus.

This forms a vapor phase which contains both steam and a vapor of the organic solvent. This mixed vapor is conducted out of the apparatus and condensed, and the resulting condensate is separated into an aqueous and an organic phase. The organic phase consists substantially of the organic solvent which may, for example, be fed back to the (meth)acrylic acid removal from the gas phase oxidation product gas mixture (for example, in the case of the standard acrylic acid removal, it may be recycled into the absorption column C10 below the feed of fresh absorbent, which reduces solvent losses). The aqueous phase consists substantially of water. It may, for example, be recycled into the apparatus to be cleaned (when the apparatus to be cleaned is, for example, a separating column (e.g. a rectification column), the aqueous phase may, for example, be recycled into the column as reflux) and/or be fed to steam generation outside the apparatus to be cleaned.

In extreme cases, the steam distillation according to the invention may also be carried out in such a way that only hot steam is passed through the emptied apparatus to be cleaned. The vapor phase withdrawn from the apparatus may be treated in the same way as described above, i.e. condensed and separated into two phases.

In general, the steam distillation according to the invention will be ended when the vapor phase removed from the apparatus to be cleaned is substantially or completely free of organic solvent. This is frequently the case after an application duration of the process according to the invention of from 1 to 20 hours. The total amount of vapor phase removed from the apparatus over the total period, based on the fill volume of the apparatus with water, is from 0.5 to 5 metric tons, frequently from 1 to 2 metric tons, per metric ton of fill volume. The fill volume is that volume which would be required to fill the emptied apparatus completely with water. It will be appreciated that it is also possible within the scope of the process according to the invention to continuously remove an aqueous flushing liquid used from the apparatus to be cleaned and, optionally after heating outside the apparatus to be cleaned (for example in a suitable heat exchanger), recycle it into the apparatus to be cleaned and thus to circulate it continuously through the apparatus to be cleaned. Pumps are used for conveying. In the case of such a circulation, preference is given to conducting the steam fed and aqueous flushing liquid used in countercurrent through the apparatus to be cleaned.

When steam is fed to the apparatus to be cleaned when carrying out the process according to the invention, its pressure, especially when the apparatus to be cleaned is a separating column, is advantageously from 1.0 to 16 bar, frequently from 1.1 to 4 bar. The steam used is preferably saturated steam. Saturated steam means that the partial water pressure makes up at least 99% of the total pressure.

Useful basic aqueous flushing liquids for the process according to the invention are also all those recommended by DE-A 19746688, DE-A 19536179, DE-A 1033359, DE-A 10211273 and DE-A 10213027.

These are in particular aqueous alkali metal and/or alkaline earth metal hydroxide and/or oxide solutions, especially, as already mentioned, the aqueous solutions of NaOH, KOH and $Ca(OH)_2$. In general, the aqueous solution has a dissolved salt content of from 0.01 to 30% by weight, preferably from 0.5 to 10% by weight.

In an advantageous development of the invention, a substantially pH-neutral (based on its aqueous solution) alkali metal and/or alkaline earth metal salt is added to the abovementioned basic aqueous alkali solution in a ratio of from >0:1 to 2:1 (weight ratio of neutral salt to hydroxide and/or oxide). Useful salts for this purpose are in particular the sulfates, acetates, oxalates, carbonates, hydrogensulfates, hydrogencarbonates and/or other salts corresponding to the hydroxidic/oxidic compounds. Such an addition allows the dissolution behavior of the basic solution for the process according to the invention to be further improved.

When an aqueous flushing liquid is advantageously used in the process according to the invention and the juncture is reached at which the vapor phase removed from the apparatus to be cleaned is substantially or completely free of organic substances, the aqueous flushing liquid is allowed to drain off and is disposed of as described in DE-A 10211273 or DE-A 10213027.

It will be appreciated that an aqueous flushing liquid used in such a way while carrying out the process according to the invention may be changed from time to time and/or exchanged for another aqueous flushing liquid. Within the apparatus to be cleaned, it is advantageously at boiling temperature in accordance with the invention.

To complete the process according to the invention, the apparatus to be cleaned is generally flushed with water (in the case of preceding use of alkali, alkali-free flushing is effected).

If required, flushing may first again be effected using an aqueous basic flushing liquid, without carrying out a steam distillation at the same time, as described in DE-A 10211273 and DE-A 10213027. If required, this flushing liquid is likewise at an elevated temperature.

The process according to the invention may either be carried out at regular intervals or else after the detection of a certain degree of polymer formation.

The process according to the invention is especially suitable when the boiling point of the organic solvent is above the boiling point of water (both at 1 atm). In other words, it is suitable in particular when the solvent is a high-boiling, preferably hydrophobic, organic absorption liquid, as recommended in DE-A 2136396 and DE-A 4308087. These are substantially liquids whose boiling points at atmospheric pressure (1 atm) are above 160° C. Examples include middle oil fractions from paraffin distillation, diphenyl ether, diphenyl or mixtures of the above-mentioned liquids, e.g. a mixture of from 70 to 75% by weight of diphenyl ether and from 25 to 30% by weight of diphenyl. It is advantageous to use a mixture consisting of a mixture of from 70 to 75% by weight of diphenyl ether and from 25 to 30% by weight of diphenyl and also, based on this mixture, from 0.1 to 25% by weight of o-dimethyl phthalate.

The (meth)acrylic acid content of the (meth)acrylic acid-containing organic solvent as treated or generated in the apparatus to be cleaned according to the invention may be ≧5% by weight, or ≧10% by weight, or ≧25% by weight, or ≧35% by weight, or ≧50% by weight, or ≧65% by weight, or ≧80% by weight, or ≧90% by weight, or ≧95% by weight, based on the solution. In general, this content is at a value of ≦90% by weight, or ≦80% by weight, or ≦65% by weight.

Apparatus to be cleaned in accordance with the invention may be any of the apparatus already mentioned in this document. This is especially true when they have been manufactured from stainless steel having the materials number 1.4541 or 1.4571 (cf. DIN Standard EN 10020).

The process according to the invention is applicable in particular to any form of separating columns (absorption, desorption, extraction and rectification columns). These may be tray columns (e.g. bubble-cap, Thormann®, sieve, tunnel-cap, dual-flow or valve trays), randomly packed columns (with Raschig rings or with Pall rings) or columns having structured packings. However, it is also applicable to any form of heat exchangers.

The process according to the invention may be carried out in the apparatus to be cleaned under reduced pressure (e.g. 10 to 100 mbar), elevated pressure or under other conditions.

When the apparatus to be cleaned according to the invention is a tray column, the process according to the invention is advantageously carried out in such a way that an aqueous basic flushing solution is conveyed through the tray column from top to bottom and steam is conducted through the tray column in countercurrent to the flushing solution in such a way that the difference between the pressure in the vapor phase immediately below the lowermost tray of the tray column and the pressure in the vapor phase immediately above the uppermost tray divided by the number of trays in the column is at least 0.5 mbar, frequently from 0.5 to 6 mbar or from 1 to 5 mbar, per tray. The froth layers generated in this way effect an improved cleaning action.

The flushing solution is advantageously withdrawn continuously from the bottom of the column and fed back to the tray column via the reflux line. Its temperature is its boiling point.

In this document, the pressure in the vapor phase "immediately" below the lowermost tray or above the uppermost tray of the tray column is intended to mean that the measuring point should not be more than 15 cm below the lowermost tray and at least 25 cm above the uppermost tray. The pressure may be measured, for example, via an open drillhole, to which a transducer is connected to the column via a wall nozzle.

It will be appreciated that it is also possible to work in a similar manner with columns having internals other than trays (e.g. Raschig rings, Pall rings or structured packings).

The advantage of the process according to the invention is based on the organic burden of an aqueous flushing solution used or applied subsequently being so low that it can be fed immediately to a water treatment plant for the purpose of aerobic degradation of the organic burden. The content of organic solvent is typically well below 100 ppm by weight. When final flushing is effected using water, the resulting washing water can generally be discharged immediately to the natural environment.

EXAMPLES

Example 1

In a 1 l four-neck flask [1] equipped with a bottom valve, mechanical stirrer, gas inlet tube, thermometer and distillation bridge, 600 g of an aqueous sodium hydroxide flushing solution were initially charged which contained dissolved polyacrylic acid and a small amount of a mixture (known as diphyl) of diphenyl and diphenyl ether. In a second 1 l four-neck flask [2] equipped with a dropping funnel, 600 g of water were initially charged (steam generator). The water in the four-neck flask [2] was heated and the steam passed through the flushing liquor via the gas inlet tube. The dropping funnel was used to meter in the amount of water evaporated. The fill levels of both four-neck flasks were kept constant.

Samples were withdrawn every hour from the four-neck flask containing the simulated flushing liquor via the bottom valve. These were analyzed for diphyl by gas chromatography. The flushing liquor still contained 1.75% by weight of free sodium hydroxide solution (based on the amount of flushing liquor).

The following table shows the results:

| Running time | Amount of steam used S | Ratio of S to amount of flushing liquor | Diphyl in sample |
|---|---|---|---|
| 0 h | 0 g | 0 | 2.2% by weight |
| 1 h | 260 g | 0.43 | 1.3% by weight |
| 2 h | 550 g | 0.92 | 0.5% by weight |
| 3 h | 920 g | 1.53 | <0.01% by weight |
| 4 h | 1290 g | 2.15 | <0.01% by weight |

After three hours, i.e. 1.5 times the amount of steam, based on the flushing liquor used, the amount of diphyl in the wastewater went below 100 ppm by weight.

Example 2

In a 10 l jacketed flanged reaction vessel equipped with a bottom valve, magnetic stirrer, gas inlet tube, thermometer and distillation bridge equipped with cooling coils, 6000 g of the flushing liquor from Example 1 were initially charged. The reaction vessel was heated to 110° C. using heat transfer oil. In a 2 l four-neck flask equipped with a dropping funnel 1000 g of water were initially charged (steam generator). The water was heated to boiling and the steam passed through the flushing liquor via the gas inlet tube. Water was metered into the steam generator via the dropping funnel. The fill levels of both containers were kept constant.

Within 12 h, a total of 9000 g of water were passed through the flushing liquor. The reactor contents were then analyzed for diphyl (gas chromatography). The diphyl content was less than 100 ppm by weight.

We claim:

1. A process for cleaning apparatus in which (meth)acrylic acid-containing organic solvents have either been treat, generated, or both treated and generated, wherein said apparatus contains residues of the organic solvent and at least one of polymers and fouling products formed by a method of making (meth)acrylic acid, which process comprises subjecting the apparatus contents to a steam distillation in the apparatus thereby forming a vapor phase, condensing the vapor phase removed from the apparatus and separating the resulting condensate into an aqueous and an organic phase, the organic phase comprising residues of the organic solvent.

2. A process as claimed in claim 1, wherein the apparatus is a rectification column, an absorption column, a desorption column or an extraction column.

3. A process as claimed in claim 1, wherein the apparatus contains an aqueous purging liquid while the process is carried out.

4. A process as claimed in claim 1, wherein steam is fed to the apparatus to be cleaned.

5. A process as claimed in claim 1, wherein the organic solvent has a boiling point above that of water.

6. A process as claimed in claim 1, wherein the content of (meth)acrylic acid in the (meth)acrylic acid-containing organic solvent is ≧5% and ≦90%, by weight.

7. A process as claimed in claim 2, wherein the apparatus contains an aqueous purging liquid while the process is carried out.

8. A process as claimed in claim 2, wherein steam is fed to the apparatus to be cleaned.

9. A process as claimed in claim 3, wherein the aqueous purging liquid is an aqueous solution of KOH and/or NaOH.

10. A process as claimed in claim 3, wherein steam is fed to the apparatus to be cleaned.

11. A process as claimed in claim 4, wherein the amount of steam fed during the process, based on the amount of water, which is required to fill the empty apparatus with water is from 1 to 2 metric tons per metric ton.

12. A process as claimed in claim 5, wherein the organic solvent has a boiling point above 160° C.

13. A process as claimed in claim 7, wherein the aqueous purging liquid is an aqueous solution of KOH and/or NaOH.

14. A process as claimed in claim 8, wherein the amount of steam fed during the process, based on the amount of water, which is required to fill the empty apparatus with water is from 1 to 2 metric tons per metric ton.

15. A process as claimed in claim 9, wherein steam is fed to the apparatus to be cleaned.

16. A process as claimed in claim 9, wherein the aqueous solution additionally contains at least one of an alkali metal salt and an alkaline earth metal salt in amounts to render the aqueous solution substantially pH-neutral.

17. A process as claimed in claim 10, wherein the amount of steam fed during the process, based on the amount of water, which is required to fill the empty apparatus with water is from 1 to 2 metric tons per metric ton.

18. A process as claimed in claim 12, wherein the organic solvent comprises at least one of diphenyl ether and diphenyl.

19. A process as claimed in claim 15, wherein the amount of steam fed during the process, based on the amount of water, which is required to fill the empty apparatus with water is from 1 to 2 metric tons per metric ton.

20. A process as claimed in claim 18, wherein the organic solvent comprises a mixture of diphenyl ether and diphenyl, and optionally including o-dimethyl phthalate.

* * * * *